US005915453A

United States Patent [19]

Tremblay et al.

[11] Patent Number: 5,915,453

[45] Date of Patent: Jun. 29, 1999

[54] MULTIPLE PART DIE CASTING DIE

[75] Inventors: Donald Tremblay, Rutland; Gene Dupre, Chicopee; Paul Kennedy, Worcester; Joseph C. Deliso, Sutton, all of Mass.

[73] Assignee: Kennedy Die Casting, Inc., Worcester, Mass.

[21] Appl. No.: 09/170,153

[22] Filed: Oct. 13, 1998

[51] Int. Cl.[6] ..... B22D 17/22

[52] U.S. Cl. ..... 164/347; 164/344

[58] Field of Search ..... 164/347, 344, 164/342

[56] References Cited

U.S. PATENT DOCUMENTS

| | | | |
|---|---|---|---|
| 3,899,282 | 8/1975 | Jesse | 164/347 |
| 5,188,165 | 2/1993 | Ivansson | 164/113 |
| 5,215,140 | 6/1993 | Beane | 164/491 |
| 5,388,629 | 2/1995 | Kami | 164/347 |
| 5,562,146 | 10/1996 | Harmon | 164/333 |

OTHER PUBLICATIONS

*Die Casting Dies: Designing*, Herman, E. A., Society of Die Casting Engineers, Inc. Detroit Michigan, 1979, pp. 1–11, and 171–178.

*Primary Examiner*—Patrick Ryan
*Assistant Examiner*—Anjan Dey
*Attorney, Agent, or Firm*—Brian M. Dingman

[57] ABSTRACT

A die casting die particularly adapted for casting of parts with protruding heat sink pins. The die ejector half insert is made of two distinct pieces. One piece, the ejector cavity insert, includes through holes which define the heat sink pin-forming cavities. These cavities are closed by a combination of the second piece of the ejector half insert, and the ejector pins. The result is a more uniform part with less flashing, which ejects easily from the die. There is also less die wear associated with the ejector pins.

12 Claims, 6 Drawing Sheets

MULTIPLE PART DIE CASTING DIE

FIELD OF THE INVENTION

This invention relates to a die casting die which is adapted to cast parts having protrusions with relatively large aspect ratios.

BACKGROUND OF THE INVENTION

In order to cast a part having a number of closely spaced protrusions with relatively large aspect ratios, such as a pin-type heat sink, it is typically necessary to have an ejector pin for each such protrusion. Having a large number of closely spaced ejector pins, each with a relatively small cross-sectional area, is problematic for a number of reasons. It is difficult to properly lubricate such pins, which increases the likelihood of pin binding and pin wear, which itself leads to problems. More maintenance time is required to repair and replace the pins. Also, since the pins contact the die cavity, they wear fairly quickly, and they also wear the die cavity, leading to the creation of flashing on the cast parts, which increases the need for costly rework. This also leads to increased down-time for pin and tool repair and replacement.

SUMMARY OF THE INVENTION

It is therefore an object of this invention to provide a multiple-piece ejector half insert for a die casting die.

It is a further object of this invention to provide such a die casting die which can be used to cast parts with one or more protrusions of relatively large aspect ratio.

It is a further object of this invention to provide such a die casting die which creates a better surface finish on such protrusions.

It is a further object of this invention to provide such a die casting die in which the cavities for such protrusions can be created using electrical discharge machining (EDM).

It is a further object of this invention to provide such a die casting die in which the ejector pins are relatively short, stable and long lasting.

It is a further object of this invention to provide such a die casting die in which the ejector pins can be lubricated.

It is a further object of this invention to provide such a die casting die in which the ejector pins do not touch the die cavity.

This invention results from the realization that parts such as pin-type heat sinks can be die cast using a two piece ejector half insert in which the upper piece has through holes which define the heat sink pins, and the lower half has smaller through holes aligned with the through holes of the upper half, and which carry the ejector pins.

This invention features in one embodiment a die casting die, for casting of a part including one or more protrusions having a large aspect ratio. The die includes a cover half insert, and a multiple-piece ejector half insert comprising an ejector cavity insert having upper and lower surfaces, and defining one or more through holes between its upper and lower surfaces, each said through hole making up the die portion for one said protrusion of said part. The ejector half insert also includes an ejector cavity sub-insert having upper and lower surfaces, its upper surface against the lower surface of said ejector cavity insert, said ejector cavity sub-insert defining one or more through holes between its upper and lower surfaces aligned with said through holes of said ejector cavity insert, said ejector cavity sub-insert's through holes at its upper surface having an area which is smaller than the area of said through holes of said ejector cavity insert at its lower surface, so that said ejector cavity sub-insert partially closes the bottom of each through hole in said ejector cavity insert. This embodiment further includes an ejector pin in each through hole of said ejector cavity sub-insert to close said ejector cavity sub-insert's through holes and thus define the bottom of each said through hole in said ejector cavity sub-insert; and means for moving said ejector pins from a casting position in which the ends of the pins are proximate the upper surface of said ejector cavity sub-insert, to an ejection position in which the ends protrude past the upper surface of said ejector cavity sub-insert, to eject said part from said ejector cavity insert.

The through holes in said ejector cavity insert may be tapered from said upper to said lower surface of said ejector cavity insert, to create tapered protrusions on said part. The ejector pins are preferably generally rectangular in cross section. The through holes in said ejector cavity insert may have a generally oval or elliptical cross-sectional shape.

The die casting die may further include an ejector pin retainer plate for holding said ejector pins, said ejector pin retainer plate spaced from the bottom of said ejector cavity sub-insert when said ejector pins are in said casting position, to allow relative movement therebetween so that said ejector pins can slide through said openings in said ejector cavity sub-insert. In this case, a substantially closed volume may then be defined between said ejector pin retainer plate and said ejector cavity sub-insert when said ejector pins are in said casting position, and said ejector pins pass through said volume. Preferably, there is further included a passageway leading to said closed volume, to allow ejector pin lubricating material to be provided into said closed volume.

Preferably, the ejector cavity insert defines a plurality of through holes, and the ejector cavity sub-insert defines an equal plurality of through holes. The through holes defined in said ejector cavity sub-insert may be of substantially uniform cross section throughout their lengths. The through holes defined in said ejector cavity insert and in said ejector cavity sub-insert may each have a central axis, and in which said central axes of said aligned through holes are essentially colinear.

In a more specific embodiment, this invention features a die casting die, for casting of a part including a plurality of tapered protrusions having a large aspect ratio, comprising a cover half insert, and a multiple-piece ejector half insert. The ejector half insert includes an ejector cavity insert having upper and lower surfaces, and defining a plurality of tapered through holes between its upper and lower surfaces, each said through hole making up the die portion for one said protrusion of said part, and an ejector cavity sub-insert having upper and lower surfaces, its upper surface held tightly against the lower surface of said ejector cavity insert, said ejector cavity sub-insert defining a plurality of through holes between its upper and lower surfaces aligned with said through holes of said ejector cavity insert, said ejector cavity sub-insert's through holes at its upper surface having an area which is smaller than the area of said through holes of said ejector cavity insert at its lower surface, so that said ejector cavity sub-insert partially closes the bottom of each through hole in said ejector cavity insert. There is an ejector pin in each through hole of said ejector cavity sub-insert to close said ejector cavity sub-insert's through holes and thus define the bottom of each said through hole in said ejector cavity sub-insert. There is also an ejector pin retainer plate for holding said ejector pins, said ejector pin retainer plate spaced from the bottom of said ejector cavity sub-insert when said ejector pins are in said casting position, to allow relative movement therebetween so that said ejector pins can slide through said openings in said ejector cavity sub-insert; in which a substantially closed volume is defined between said ejector pin retainer plate and said ejector cavity sub-insert when said ejector pins are in said casting position, and said ejector pins pass through said volume. There is also a passageway leading to said closed volume, to allow ejector pin lubricating material to be provided into said closed volume.

This embodiment further includes means for moving said ejector pins from a casting position in which the ends of the pins are proximate the upper surface of said ejector cavity sub-insert, to an ejection position in which the ends protrude past the upper surface of said ejector cavity sub-insert, to eject said part from said ejector cavity insert.

Also featured in this invention is a two-part ejector half insert for a die casting die. The two-part ejector half insert includes an ejector cavity insert having upper and lower surfaces, and defining one or more through holes between its upper and lower surfaces, each said through hole making up the die portion for one said protrusion of said part, and an ejector cavity sub-insert having upper and lower surfaces, its upper surface against the lower surface of said ejector cavity insert, said ejector cavity sub-insert defining one or more through holes between its upper and lower surfaces aligned with said through holes of said ejector cavity insert, said ejector cavity sub-insert's through holes at its upper surface having an area which is smaller than the area of said through holes of said ejector cavity insert at its lower surface, so that said ejector cavity sub-insert partially closes the bottom of each through hole in said ejector cavity insert.

BRIEF DESCRIPTION OF THE DRAWINGS

Other objects, features and advantages will occur to- those skilled in the art from the following description of the preferred embodiment, and the accompanying drawings, in which.

DESCRIPTION OF THE PREFERRED EMBODIMENT

This invention may be accomplished in a die casting die, for casting of a part including one or more protrusions having a large aspect ratio. The die includes a cover half insert. The invention lies in the multiple-piece ejector half insert, which comprises an ejector cavity insert having upper and lower surfaces, and defining one or more through holes between its upper and lower surfaces, each such through hole making up the die portion for one protrusion of the part being cast. The ejector half insert also includes an ejector cavity sub-insert having upper and lower surfaces, with its upper surface held in a liquid-tight manner against the lower surface of the ejector cavity insert. The ejector cavity sub-insert defines one or more through holes between its upper and lower surfaces, which are aligned with the through holes of the ejector cavity insert. The ejector cavity sub-insert's through holes at its upper surface have an area which is smaller than the area of the through holes of the ejector cavity insert at its lower surface, so that the ejector cavity sub-insert partially closes the bottom of each through hole in the ejector cavity insert.

The die also includes an ejector pin in each through hole of the ejector cavity sub-insert, to close the ejector cavity sub-insert's through holes and thus define the bottom of each through hole in the ejector cavity sub-insert. Further included are means for moving the ejector pins from a casting position in which the ends of the pins are flush with the upper surface of the ejector cavity sub-insert, to an ejection position in which the ends protrude past the upper surface of the ejector cavity sub-insert, to eject the part from the ejector cavity insert.

Figure 1:
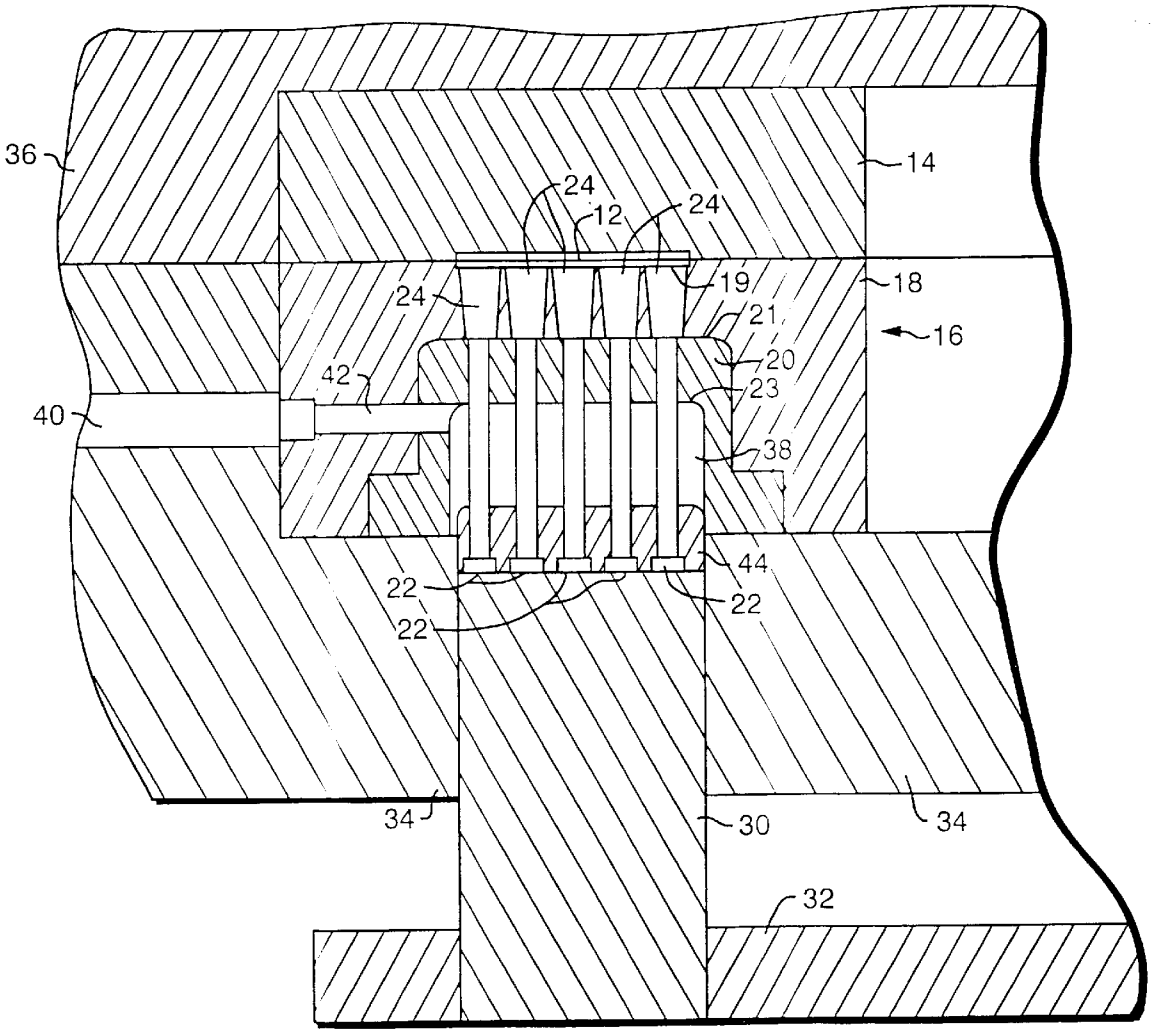
FIG. 1 is a partial, cross-sectional drawing of a die casting die of this invention.
Figure 2A:
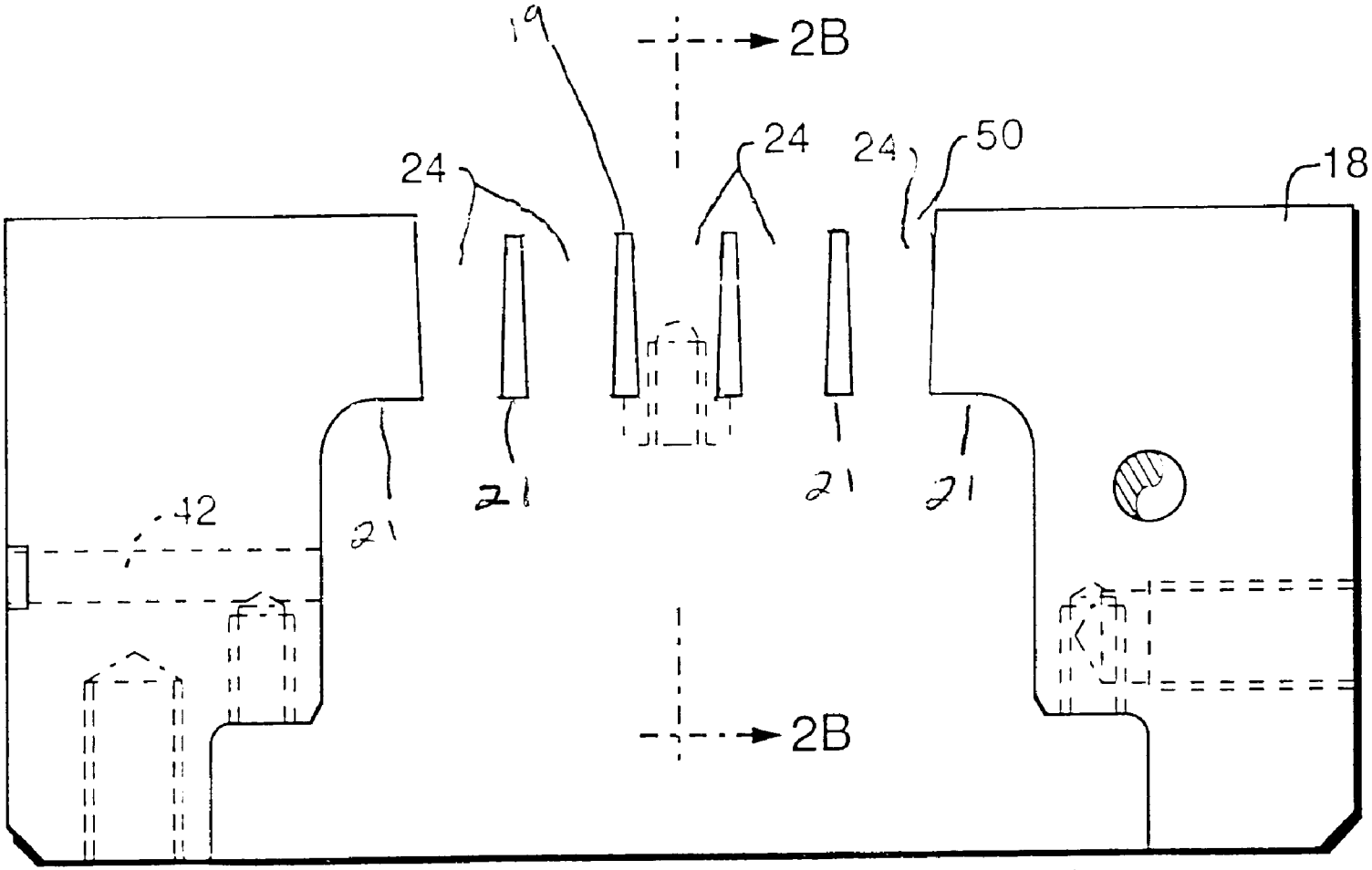
FIGS. 2A and 2B are cross-sectional views of the ejector cavity insert of FIG. 1.
Figure 2B:
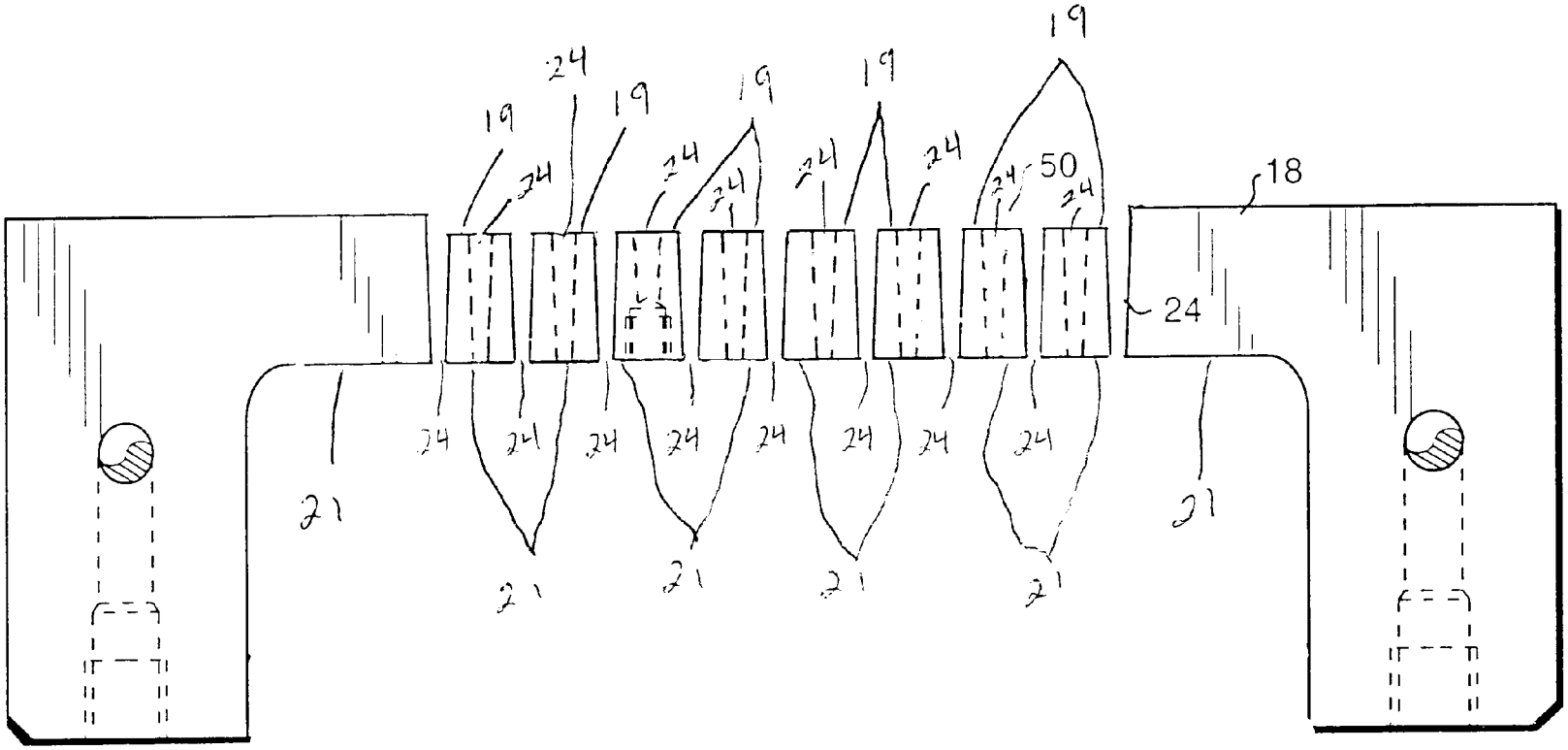
Figure 3A:
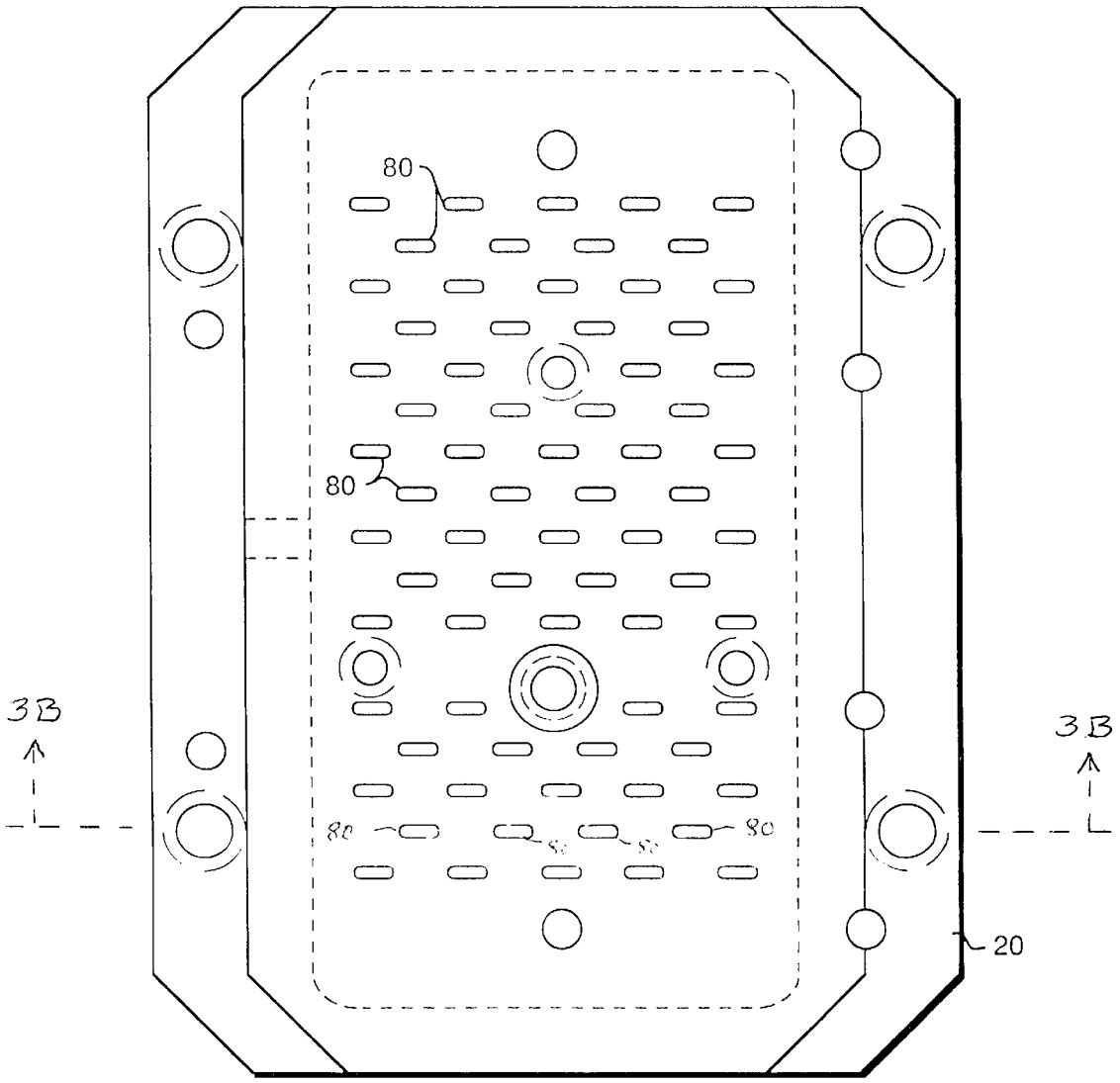
FIG. 3A is a top view of the ejector cavity sub-insert of FIG. 1.
Figure 3B:
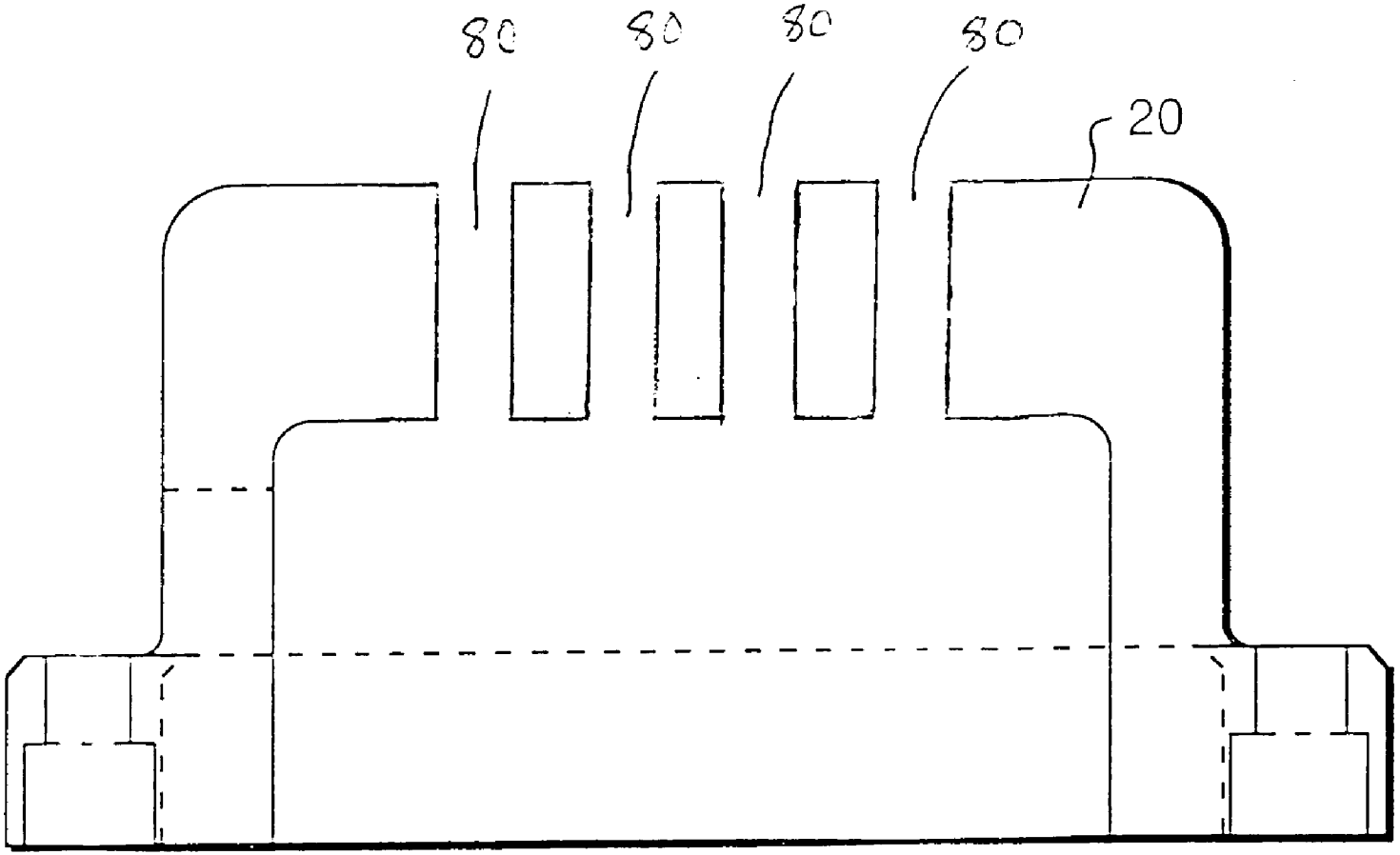
FIG. 3B is a cross-sectional view of the ejector cavity sub-insert of FIG. 3A.

FIG. 1 details one quadrant of a multiple (in this case four) cavity die casting die according to this invention. Standard cover half insert 14 is carried by cover half retainer 36, and defines a portion of cavity 12 which forms the body 102 of heat sink 100, FIG. 4 Ejector half insert 16 of this invention is a multiple-piece (preferably two pieces as shown in the drawings) member comprising ejector cavity insert 18 and ejector cavity sub-insert 20. Orthogonal cross-sectional views of ejector cavity insert 18 are shown in FIGS. 2A and 2B. The top of insert 18 defines one portion 50 of cavity 12. Top and cross sectional views of ejector cavity sub-insert 20 are shown in FIGS. 3A and 3B. Members 18 and 20 are bolted together, and member 18 is bolted to member 34, in conventional fashion.

Ejector pins 22 are carried by ejector pin retainer plate 44, which itself is carried by ejector plate transfer pillar 30. Pillar 30 is fixed to ejector plate 32, and can move relative to ejector half retainer 34. This relative motion moves ejector pins 22 relative to ejector cavity insert 18, to eject the cast part from cavity 12.

In the casting position shown in FIG. 1, an essentially closed cavity 38 is defined between ejector pin retainer plate 44 and ejector cavity sub-insert 20. Aligned passageways 40 and 42 provide a passageway for ejector pin lubrication material to be provided into cavity 38, to keep pins 22 properly lubricated.

Ejector cavity insert 18 defines a series of tapered through-holes 24 between its upper surface 19, which defines the lower portion of cavity 12, and its lower surface 21, which is adjacent to the upper surface of ejector cavity sub-insert 20. The length of through-holes 24 is approximately 0.870 inches. (The terms "upper" and "lower" as used herein are arbitrarily selected in order to allow description of the relative position of various parts. This does not imply the actual position of the die in use.) Each through hole 24 makes up the die portion for one protruding pin of the pin-type heat sink 100 (FIG. 4) cast in the die of FIG. 1. One advantage of such relatively large, relatively uniform through holes 24 (as opposed to blind holes) is that they can be created using wire EDM techniques, which results in smooth, uniform walls requiring less smoothing and rework as compared to traditional die cavities which are formed by machining blind holes, followed by polishing. The result is a more uniform, better looking part which requires less rework than parts made with dies having blind casting cavities. Also, through holes are easier to lubricate, and are easier to release parts from.

The lower ends of through holes 24 are closed by a combination of the upper surface of ejector cavity sub-insert 20, and the ends of ejector pins 22. Through holes 80 (FIG. 3A) in sub-insert 20 carry ejector pins 22 (not shown in FIG. 3A). Holes 80 have approximately the same generally rectangular cross-sectional shape as the ejector pins 22, but are slightly larger, so that the pins can ride through such openings; the running clearance is typically 0.001–0.0015". Through holes 24, in ejector cavity 18, which each form one of the protruding pins 104 of heat sink 100, FIG. 4 and through holes 80 in sub-insert 20 which carry ejector pins 22, are essentially colinear. Since through holes 80 in sub-insert 20 are smaller than the openings of through holes 24, (the lower ends of through holes 24 are oval shaped, about 0.415 by 0.101 inches, and through holes 80 are rounded-corner rectangular holes about 0.25 by 0.080 inches) the top of sub-insert 20 partially closes the lower end of each opening of through holes 24. The ends of ejector pins 22 close the remainder of each opening 24. Because the ejector pins 22 do not contact the die cavity, as is the case in prior art dies, the ejector pins and the die don't wear as quickly, which increases their life, and thus decreases maintenance down time, and also decreases the amount of flashing on the ejector pins, thus decreasing the need for rework of the cast parts, and also assisting in release of the parts.

Also, having through holes in the die allows better coverage by release substances, which further eases release of the parts. The result is a long-lasting die from which high-quality parts are easily ejected.

Figure 4:
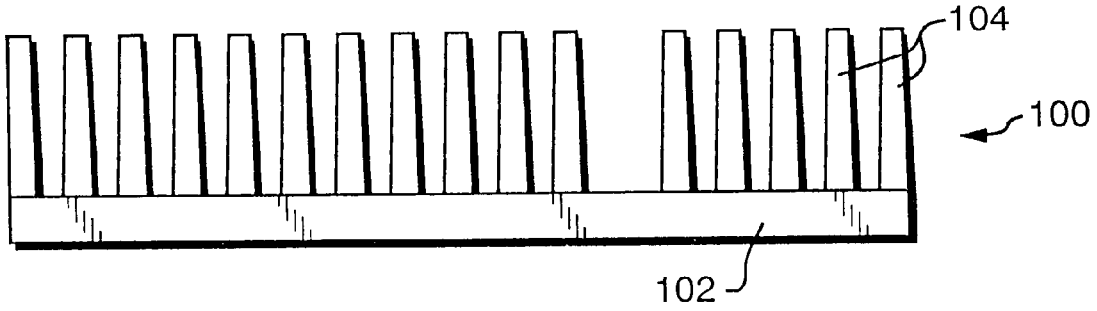
FIG. 4 is a side view of a pin-type heat sink cast in the die shown in the previous drawings.
Figure 5:
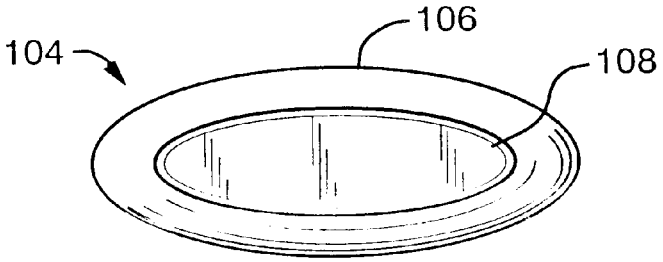
FIG. 5 is an enlarged, top view of one pin of the heat sink of FIG. 4.

Pin-type heat sink 100, cast in the die shown in the previous figures, is depicted in FIG. 4. Body 102 is formed by cavity 12 (FIG. 1), and tapered, protruding pins 104 are formed by through holes 24 (FIG. 1). As shown in the top view of FIG. 5, pins 104 have a base 106 which is larger than top 108; this tapering eases the ejection of the protruding pins of heat sink 100 from ejector cavity insert 18.

The invention is well suited for casting of parts with projecting portions, particularly heat sink fins and/or pins. The advantages of the invention accrue regardless of the cross-sectional shape of such protrusions.

Although specific features of this invention are shown in some drawings and not in others, this is for convenience only as each feature may be combined with any or all of the other features in accordance with the invention.

Other embodiments will occur to those skilled in the art and are within the following claims:

What is claimed is:

1. A die casting die, for casting of a part including one or more protrusions having a large aspect ratio, comprising:

a cover half insert;

a multiple-piece ejector half insert comprising:

an ejector cavity insert having upper and lower surfaces, and defining one or more through holes between its upper and lower surfaces, each said through hole making up the die portion for one said protrusion of said part; and an ejector cavity sub-insert having upper and lower surfaces, its upper surface against the lower surface of said ejector cavity insert, said ejector cavity sub-insert defining one or more through holes between its upper and lower surfaces aligned with said through holes of said ejector cavity insert, said ejector cavity sub-insert's through holes at its upper surface having an area which is smaller than the area of said through holes of said ejector cavity insert at its lower surface, so that said ejector cavity sub-insert partially closes the bottom of each through hole in said ejector cavity insert;

an ejector pin in each through hole of said ejector cavity sub-insert to effectively close said ejector cavity sub-insert's through holes to the material being cast, and thus define the bottom of each said through hole in said ejector cavity sub-insert; and means for moving said ejector pins from a casting position in which the ends of the pins are proximate the upper surface of said ejector cavity sub-insert, to an ejection position in which the ends protrude past the upper surface of said ejector cavity sub-insert, to eject said part from said ejector cavity insert.

2. The die casting die of claim 1 in which said through holes in said ejector cavity insert are tapered from said upper to said lower surface of said ejector cavity insert, to create tapered protrusions on said part.

3. The die casting die of claim 1 in which said through holes in said ejector cavity insert have a generally oval cross-sectional shape.

4. The die casting of claim 1 in which said ejector pins are generally rectangular in cross-section.

5. The die casting die of claim 1 further including an ejector pin retainer plate for holding said ejector pins, said ejector pin retainer plate spaced from the bottom of said ejector cavity sub-insert when said ejector pins are in said casting position, to allow relative movement therebetween so that said ejector pins can slide through said openings in said ejector cavity sub-insert.

6. The die casting die of claim 5 in which a substantially closed volume is defined between said ejector pin retainer plate and said ejector cavity sub-insert when said ejector pins are in said casting position, and said ejector pins pass through said volume.

7. The die casting die of claim 6 further including a passageway leading to said closed volume, to allow ejector pin lubricating material to be provided into said closed volume.

8. The die casting die of claim 1 in which said ejector cavity insert defines a plurality of through holes.

9. The die casting die of claim 8 in which said ejector cavity sub-insert defines an equal plurality of through holes.

10. The die casting die of claim 1 in which said through holes defined in said ejector cavity sub-insert are of substantially uniform cross section throughout their lengths.

11. The die casting die of claim 1 in which said through holes defined in said ejector cavity insert and in said ejector cavity sub-insert each have a central axis, and in which said central axes of said aligned through holes are essentially colinear.

12. A die casting die, for casting of a part including a plurality of tapered protrusions having a large aspect ratio, comprising:

a cover half insert;

a multiple-piece ejector half insert comprising;

an ejector cavity insert having upper and lower surfaces, and defining a plurality of tapered through holes between its upper and lower surfaces, each said through hole making up the die portion for one said protrusion of said part; and an ejector cavity sub-insert having upper and lower surfaces, its upper surface held tightly against the lower surface of said ejector cavity insert, said ejector cavity sub-insert defining a plurality of through holes between its upper and lower surfaces aligned with said through holes of said ejector cavity insert, said ejector cavity sub-insert's through holes at its upper surface having an area which is smaller than the area of said through holes of said ejector cavity insert at its lower surface, so that said ejector cavity sub-insert partially closes the bottom of each through hole in said ejector cavity insert;

an ejector pin in each through hole of said ejector cavity sub-insert to close said ejector cavity sub-insert's through holes and thus define the bottom of each said through hole in said ejector cavity sub-insert;

an ejector pin retainer plate for holding said ejector pins, said ejector pin retainer plate spaced from the bottom of said ejector cavity sub-insert when said ejector pins are in said casting position, to allow relative movement therebetween so that said ejector pins can slide through said openings in said ejector cavity sub-insert; in which a substantially closed volume is defined between said ejector pin retainer plate and said ejector cavity sub-insert when said ejector pins are in said casting position, and said ejector pins then pass through said volume;

a passageway leading to said closed volume, to allow ejector pin lubricating material to be provided into said closed volume; and means for moving said ejector pins from a casting position in which the ends of the pins are proximate the upper surface of said ejector cavity sub-insert, to an ejection position in which the ends protrude past the upper surface of said ejector cavity sub-insert, to eject said part from said ejector cavity insert.

* * * * *